United States Patent [19]

Katoh

[11] Patent Number: 4,566,364

[45] Date of Patent: Jan. 28, 1986

[54] ELECTRONIC MUSICAL INSTRUMENT CONTROLLING A TONE WAVESHAPE BY KEY SCALING

[75] Inventor: Mitsumi Katoh, Hamamatsu, Japan

[73] Assignee: Nippon Gakki Seizo Kabushiki Kaisha, Hamamatsu, Japan

[21] Appl. No.: 619,839

[22] Filed: Jun. 12, 1984

[30] Foreign Application Priority Data

Jun. 14, 1983 [JP] Japan ..... 58-104949
Jun. 14, 1983 [JP] Japan ..... 58-104950

[51] Int. Cl.[4] ..... G10H 1/02
[52] U.S. Cl. ..... 84/1.19
[58] Field of Search ..... 84/1.19, 1.21, 1.22, 84/1.01, 1.24

[56] References Cited

U.S. PATENT DOCUMENTS 4,224,856 9/1980 Ando et al. ..... 84/1.19
4,437,379 3/1984 Okumura ..... 84/1.22

*Primary Examiner*—Forester W. Isen

*Attorney, Agent, or Firm*—Spensley, Horn, Jubas & Lubitz

[57] ABSTRACT

Plural channels of tone generation capable of selectively generating plural kinds of waveshape signals are provided. A waveshape signal to be selected in each of the channels is designated in accordance with the tone pitch or tone range of a tone to be generated and waveshape signals which differ from each other between the channels are respectively generated. The different waveshape signals of the respective channels are weighted by scaling parameters according to the tone pitch. A circuit capable of providing the waveshape signal with amplitude envelopes which differ from each other between the channels is further provided and selection between imparting of such envelopes and weighting in accordance with the scaling parameter is made in response to a tone color. A plurality of tone synthesis systems having the tone synthesis function described may be provided and tone signals obtained in the respective systems may be added together.

13 Claims, 7 Drawing Figures

| WAVESHAPE ADDRESS | MEMORY 12 (I) | MEMORY 13 (II) | |
|---|---|---|---|
| 1 | I - 1 | II - 1 | TONE COLOR A |
| 2 | I - 1 | II - 1 | TONE COLOR C |
| 3 | I - 2 | II - 2 | |
| 4 | I - 3 | II - 1 | TONE COLOR D |
| 5 | I - 1 | II - 2 | |
| 6 | I - 2 | II - 3 | |
| 7 | I - 1 | II - 1 | |
| 8 | I - 2 | II - 2 | |
| 9 | I - 3 | II - 3 | |
| 10 | I - 4 | II - 4 | |
| 11 | I - 5 | II - 1 | |
| 12 | I - 1 | II - 2 | |
| 13 | I - 2 | II - 3 | |
| ⋮ | ⋮ | ⋮ | |
| N | | II - 1 | TONE COLOR B |
| N + 1 | I - 1 | ⋮ | |
| ⋮ | ⋮ | | |

FIG. 3

ELECTRONIC MUSICAL INSTRUMENT CONTROLLING A TONE WAVESHAPE BY KEY SCALING

BACKGROUND OF THE INVENTION

This invention relates to an electronic musical instrument and, more particularly, to a key scaling technique controlling a waveshape of a generating tone in accordance with the tone pitch of the tone or a tone range to which the tone belongs.

Known in the art is a technique as disclosed in the specification of U.S. Pat. No. 4,437,379 in which two kinds of waveshapes for a high frequency tone range and a low frequency tone range are respectively prepared and a waveshape of an intermediate tone range therebetween is produced through interpolation between the two kinds of waveshapes by the use of a scaling (weighting) coefficient corresponding to the tone pitch (tone range) of the tone to be generated. In the prior art technique, the waveshapes used for scaling are fixed to the two kinds of tone ranges, i.e., those for the high frequency tone range and the low frequency tone range resulting in an inadequate key scaling control. In some tone colors to be realized, it is desirable that scaling characteristics of several kinds should be provided for corresponding tone ranges. Such control, however, has not been feasible at all in the prior art technique.

On the other hand, there are some tone colors that do not require key scaling. In those tone colors, tone generation and control circuits of plural channels provided for key scaling are wasted.

It is, therefore, an object of the present invention to provide an electronic musical instrument capable of controlling modes of key scaling characteristic of a tone waveshape in various manners thereby to obtain a tone of a good quality whose tone waveshape changes in accordance with the tone pitch or tone range.

It is another object of the invention to provide an electronic musical instrument capable of utilizing tone generation and control circuits without waste and synthesizing a tone in a manner suited for the tone color to be generated. More specifically, there is provided an electronic musical instrument capable of selectively effecting, depending upon a tone color to be produced, synthesis of a tone of a desired characteristic by key scaling a tone waveshape in accordance with the tone pitch (tone range) of the tone to be generated or synthesis of a tone of a desired characteristic by combining tones of plural tone generation systems imparted with different envelopes.

It is still another object of the invention to provide an electronic musical instrument in which plural systems for controlling a tone waveshape by the key scaling technique are provided to realize a control which is even richer in variety.

SUMMARY OF THE INVENTION

According to the present invention, there are provided plural systems of tone generation means capable of selectively generating waveshape signals of plural kinds and generating a tone signal corresponding to a selected waveshape signal in accordance with the tone pitch of a tone to be generated and waveshape designation means for designating a waveshape signal to be selected in the tone generation means of the respective systems in accordance with the tone pitch of the tone to be generated. The waveshape signals selected on the basis of the designation by the waveshape designation means are generated in the tone generation means of the respective systems and these waveshape signals (tone signals) of the respective systems are weighted at a suitable ratio and mixed together in weighting means.

In the weighting means, tone signals of the respective systems are weighted at a predetermined ratio corresponding to their tone pitches. In the waveshape designation means, when the tone pitch of the tone belongs to a predetermined tone range, a waveshape signal corresponding to this tone range is designated. The waveshape signals of the respective systems which have been selected in accordance with the tone range are weighted at a ratio corresponding to relative tone pitches in the tone range of the generating tone and mixed together. The width of a tone range corresponding to one kind of waveshape signal and the contents of the waveshape signal differ depending upon the tone color. In the waveshape designation means, therefore, kinds of waveshape signals to be selected in the respective systems are respectively designated in accordance with both the tone color designation information and the tone pitch designation information.

For achieving another object of invention, envelope imparting means for imparting tone signals generated by the tone generation means of the respective systems with individual amplitude envelopes is further provided and the operation of the weighting means for the key scaling and the operation of the envelope imparting means are selectively controlled in accordance with the tone color. In a case where a tone color to be subjected to the key scaling has been selected, the weighting means is allowed to weight tone signals of the respective systems at a ratio corresponding to designated tone pitches and the envelope imparting means imparts the tone signals of the respective systems with a common envelope. In a case where a tone color which should be provided with an effect created by different envelopes such as an attack effect has been designated, key scaling is not performed in the weighting means but envelopes which differ from one another (e.g., an attack envelope and a sustain envelope) are separately imparted to tone signals of the respective systems by the envelope imparting means.

For achieving still another object of the invention, a plurality of tone synthesis systems are provided each of which comprises the tone generation means of plural systems, the waveshape designation means, the weighting means and, if necessary, the envelope imparting means and output tone signals of these tone synthesis systems are added together for synthesis.

BRIEF DESCRIPTION OF THE DRAWINGS

In the accompanying drawings,

FIG. 3 is a diagram showing an example of storing waveshapes in waveshape memories of two systems in the above embodiment;

DESCRIPTION OF PREFERRED EMBODIMENTS

Figure 1:
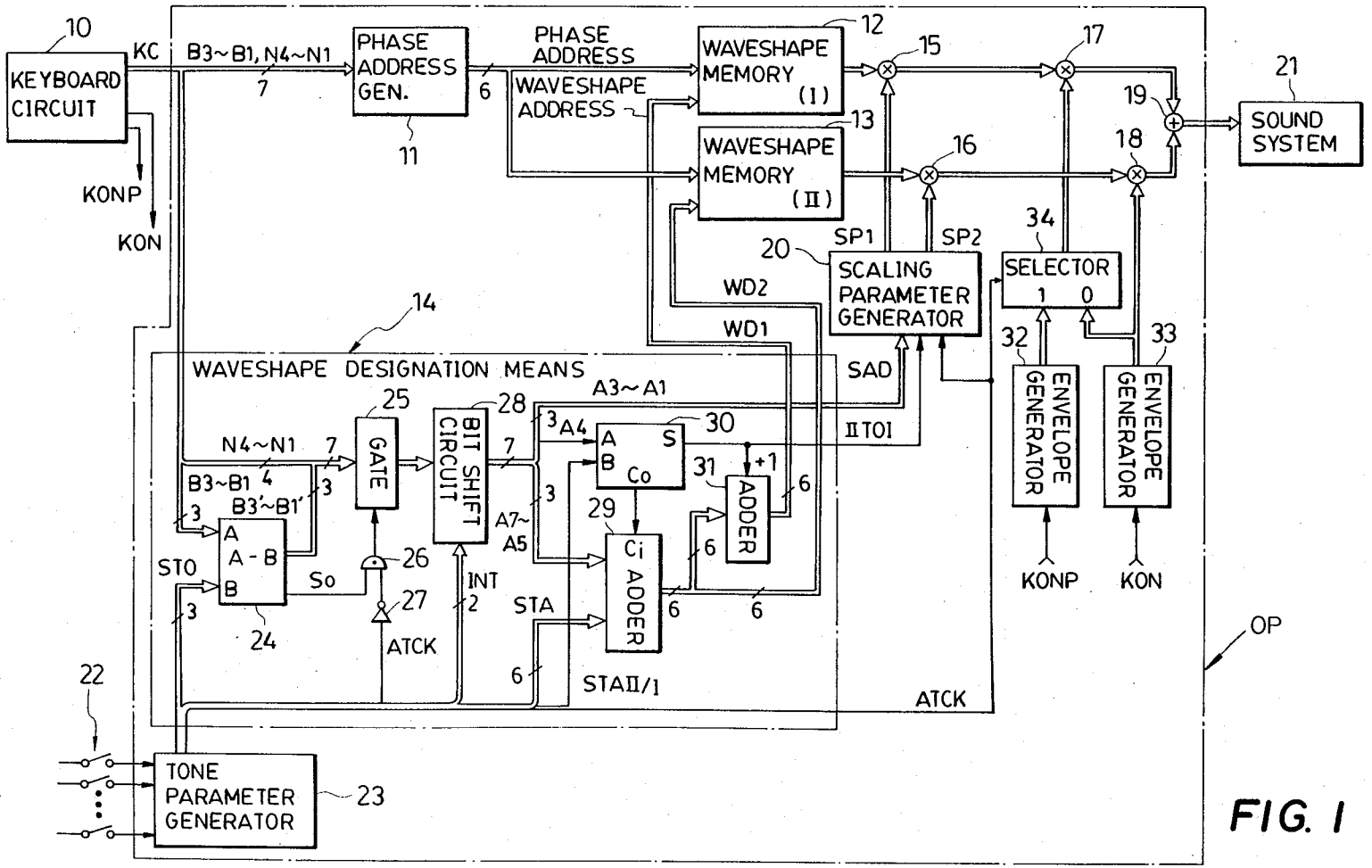
FIG. 1 is an electrical block diagram showing an embodiment of the electronic musical instrument according to the invention.

In the embodiment of the invention shown in FIG. 1, a keyboard circuit 10 constitutes means for designating a tone pitch of a tone to be generated by depression of a key. The keyboard circuit 10 produces a key code KC representing a depressed key, a key-on signal KON which maintains "1" while the key is being depressed and a key-on pulse KONP which is transitorily turned to "1" upon starting depression of the key. The key code KC consists of an octave code B3–B1 made up of 3 consecutive bits including the most significant bit and a note code N4–N1 made up of 4 consecutive bits including the least significant bit. A phase address generator 11 generates phase address data corresponding to instantaneous phase angle information which changes at a rate corresponding to the tone pitch of a tone to be generated.

Waveshape memories 12 and 13 of two systems are provided as tone generation means of a plurality of systems capable of selectively generating waveshape signals of plural kinds and generating a tone signal corresponding to a selected waveshape signal in accordance with a designated tone pitch. Waveshape designating codes WD1 and WD2 from waveshape designation means 14 are applied to waveshape selection addresses of the waveshape memories 12 and 13 and the kind of waveshape designated by the code WD1 or WD2 is selected, i.e., turned into a readable state, and the selected waveshape signal is repeatedly read out in accordance with the phase address data provided by the phase address generator 11. For example, one kind of waveshape signal consists of a waveshape of one cycle and each of the waveshape memories 12 and 13 stores 64 kinds of waveshapes each sampled at 64 sample points to be stored at 64 addresses of the memory.

For weighting and mixing waveshape signals read out from the respective memories 12 and 13 at a suitable ratio, multipliers 15 to 18 and an adder 19 are provided. A scaling parameter generator 20 prestores a predetermined scaling characteristics function and produces, to the multipliers 15 and 16 of the respective systems, scaling parameters (weighting coefficients) SP1 and SP2 which are determined by the scaling characteristics function using the tone pitch of the tone to be produced as a variable. A tone signal read out from the waveshape memory 12 of the first system and the scaling parameter SP1 are applied to the multiplier 15, whereas a tone signal read out from the waveshape memory 13 of the second system and the scaling parameter SP2 are applied to the multiplier 16. Thus, the tone signals of the respective systems are weighted at a ratio corresponding to the tone pitches thereof. Outputs of the multipliers 15 and 16 are applied to the adder 19 via separate multipliers 17 and 18 provided for imparting amplitude envelopes. The tone signals added together in the adder 19 are supplied to a sound system 21.

A tone color selection switch 22 is provided for selecting various tone colors. A tone parameter generator 23 generates a tone parameter for realizing the tone color which has been selected by this tone color selection switch 22 and is composed, for example, of a read-only memory. The waveshape designation means 14 is controlled in accordance with the tone parameter, i.e., tone color designation information, generated by this tone parameter generator 23 and the scaling characteristic function in the scaling parameter generator 20 is thereby controlled.

The waveshape designation means 14 generates waveshape designating codes WD1 and WD2 in accordance with the key code KC provided by the keyboard circuit 10 and the tone parameter provided by the tone parameter generator 23. The waveshape memories 12 and 13 respectively store one or more kinds of waveshapes for each tone color. The address region storing a waveshape corresponding to the designated tone is specified by the tone parameter and an individual waveshape selection address in the address region is specified by the key code KC, the waveshape designating codes WD1 and WD2 being generated in accordance with the specified contents. More specifically, the width of a tone range corresponding to one kind of waveshape is determined, i.e., the mode of tone range demarcation is determined in accordance with the designated tone color and the waveshape designating codes WD1 and WD2 are generated in accordance with the tone range thus determined (demarcated) covers which the tone pitch designated by the key code KC.

Upon determination of the width of the tone range corresponding to the waveshape of one kind in accordance with the designated tone color, the inclination of the scaling characteristics function is determined in accordance with this width of the tone range. The tone pitch designation information which constitutes a variable input for reading out the scaling characteristic function from the scaling parameter generator 20 is expressed by relative tone pitch information in the tone range corresponding to the waveshape of the above described one kind. For this purpose, a certain circuit in the waveshape designation means 14 is conveniently utilized to process the key code KC in response to the tone parameter (tone color designation information) and thereby generate scaling address data SAD corresponding to the relative tone pitch information. This data SAD is supplied to the address input (variable input) of the scaling parameter 20.

Figure 2:
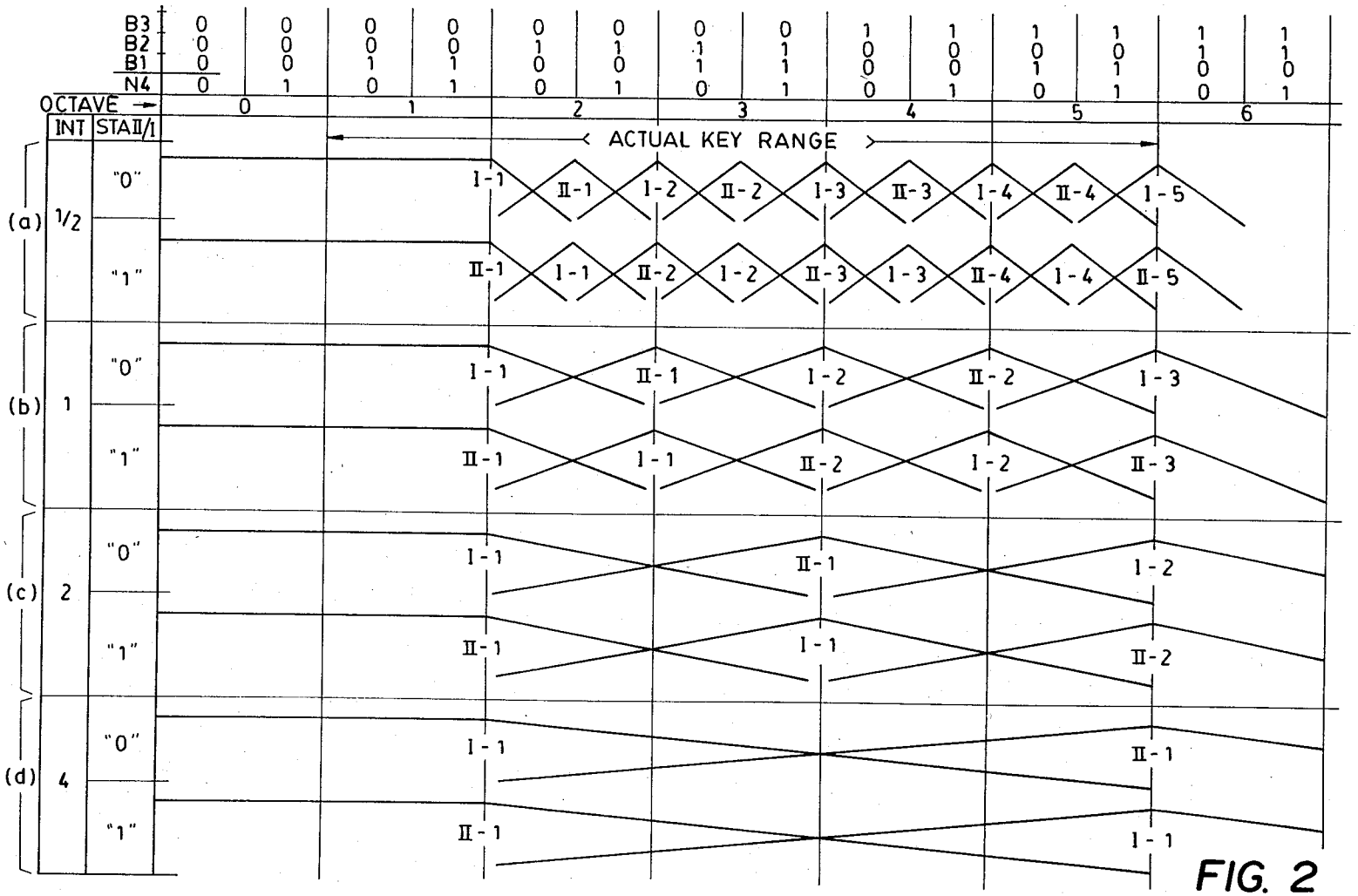
FIG. 2 is a diagram showing a typical example of key scaling characteristics in the embodiment shown in FIG. 1.

FIG. 20 shows typical patterns of the key scaling characteristics to be realized by the present embodiment. These patterns are classified into four groups (a) through (d), according to the width of a tone range corresponding to one waveshape. In a case where a waveshape of one kind is used for key scaling in a certain tone range, the scaling is effected with scaling characteristics of a positive or negative inclination for each half tone range. In other words, one inclination is completed with an interval of half the tone range corresponding to one waveshape. This interval is represented by interval data INT. When the tone range width corresponding to one waveshape is one octave, the interval data INT is "$\frac{1}{2}$" representing $\frac{1}{2}$ octave and the pattern in this case is shown in FIG. 2(*a*). When the tone range width corresponding to one waveshape is 2 octaves, the interval data INT is "1" representing 1 octave and the pattern in this case is shown in FIG. 2(*b*). When the tone range width corresponding to one waveshape is 4 octaves, the interval data INT is "2" representing 2 octaves and the pattern in this case is shown in FIG. 2(*c*). When the tone range width corresponding to one waveshape is 8 octaves, the interval data INT is "4" representing 4 octaves and the pattern in this case is shown in FIG. 2(*d*).

The horizontal axis of FIG. 2 represents the tone pitch which is graduated for convenience by octave, each graduation being affixed with octave numbers of 0 to 6. It is assumed that the actual key range covers 5 octaves of the first to the fifth octave. The vertical axis represents the level of the scaling characteristics, i.e., the tone signal amplitude level set by the scaling parameters SP1 and SP2. The systems of the waveshape memories 12 and 13 are distinguished by reference characters I and II. I corresponds to the first system, i.e., waveshape memory 12 and II to the second system, i.e., waveshape memory 13. Suffixes 1, 2, 3, 4 and 5 hyphenated to the reference characters I and II are used for distinguishing the kind of waveshape used for each tone range. For example, in the scaling characteristic of the upper stage of FIG. 2(*a*), five kinds of waveshapes I-1 through I-5 stored in the waveshape memory 12 of the first system are used in the respective tone ranges and four kinds of waveshapes II-1 through II-4 stored in the waveshape memory 13 of the second system are used in the respective tone ranges.

In each of FIGS. 2(*a*)–2(*d*), the patterns of the scaling characteristics of two kinds are shown in upper and lower stages. These patterns are distinguished from each other depending upon which of the first and second systems (I, II) generates the waveshape most emphasized in the lowest tone range. The upper stage represents the pattern in which the waveshape of the first system I (waveshape memory 12) is emphasized in the lowest tone range whereas the lower stage represents the pattern in which the waveshape of the second system II (waveshape memory 13) is emphasized in that range. Which of the two waveshapes is to be emphasized in the lowest tone range is indicated by a start address distinction signal STAII/I. When this signal STAII/I is "0", it represents the first system (I) and when this signal is "1", it represents the second system (II).

The above described two way control in the key scaling of the same characteristics is made not on the basis of musical requirement but on the basis of requirement of a circuit technique, i.e., effective utilization of the waveshape memory capacity. As shown in FIG. 2, the number of waveshape types used for one key scaling characteristics for the first system (waveshape memory 12) is, in most cases, not the same as that for the second systems (waveshape memory 13) and if one is an odd number the other is an even number. Accordingly, in a case where waveshapes corresponding to one tone color are stored at the same address of the respective memories 12 and 13, an address region for one waveshape becomes superfluous in either of the memories 12 and 13. If this superfluous address region is left unused, much waste is produced in the memory. In the present embodiment, therefore, all regions of the memories are filled with waveshapes to avoid occurrence of a waste region. In this case, for distinguishing which address of either memory 12 or 13 the memory region of plural waveshapes for one tone color starts from, a start address distinction signal STAII/I and start address data STA are used.

FIG. 3 shows an example of memory formats of the waveshape memories 12 and 13, wherein one or a plurality of different waveshapes corresponding to the same tone color are stored in a continuous waveshape address or addresses, each representing a group of memory addresses covering 64 sample points of a waveshape, such that the pitch grows higher as the waveshape address advances. The foremost address in a group of waveshape addresses related to the same tone color is called a start address, which stores a waveshape corresponding to the lowermost compass. For example, the tone color A indicated in FIG. 3 corresponds to the scaling pattern shown in the upper row of FIG. 2(*d*) and waveshapes I-1, II-2 are stored in the same address 1 of the first and second waveshape memories 12, 13 respectively. In this case, the start address data STA is "1" and the start address distinction signal STAII/I is "0" (designating I). The waveshape of a tone color corresponding to the scaling pattern shown in the lower row of FIG. 2(*d*) is stored as a tone color B shown in FIG. 3. More precisely, the waveshape II-I is stored in the address N of the second waveshape memory 13 while the waveshape I-1 is stored in the address N+1 of the first waveshape memory 12. In this case, the start address data STA is "N" and the distinction signal STAII/I is "1" (designating II). The waveshape of a tone color corresponding to the scaling pattern shown in the lower row of FIG. 2(*b*) is stored as a tone color C shown in FIG. 3. In this case, the start address STA is "4" and the distinction signal STAII/I is "1" (designating II). It will be seen from FIG. 3 that the waveshape address 4 of the second waveshape memory 13 is not left idle to make a full use of the memory. The waveshape addresses of the memories 12 and 13 are designated by the waveshape designating codes WD1, WD2, respectively.

Corresponding to the tone color, the scaling can be started from any octave. FIG. 2 illustrates an example in which the scaling is started from the second octave. The octave from which to start the scaling is designated by the start octave data STO. In the compass lower than the start octave, no scaling is effected and therefore the waveshape change does not take place.

Note that FIG. 2 gives the values of the most significant four bits of the key code KC in every semioctave along the horizontal line. A particular semioctave is specified by the 3-bit octave code B3, B2, B1 and the most significant bit N4 of the note code. In the case of a pattern as shown in FIG. 2(*a*), the horizontal distance or the run of one slope of the scaling characteristics is equal to a semioctave so the sign of the slope alters in every semioctave.

In a compass corresponding to one slope of scaling characteristics, when the slope of scaling characteristics of one system I (or II) is negative, the slope of the scaling characteristics of the other system II (or I) is positive. When the scaling starts from the lowermost compass, the scaling characteristics slope of the system emphasized at said lowermost compass is negative and the scaling characteristics slope of the other system is positive. The additive synthesis of tone signals on both systems scaled by such oppositely directed scaling characteristics enables a key scaling in which the waveshape changes gradually from a waveshape of one system to a waveshape of another system according to the pitch.

Figure 4A:
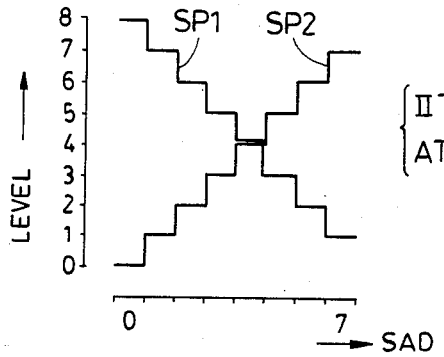
FIGS. 4*a* and 4*b* are graphs showing patterns of generation of the scaling characteristics function in the above embodiment.
Figure 4B:
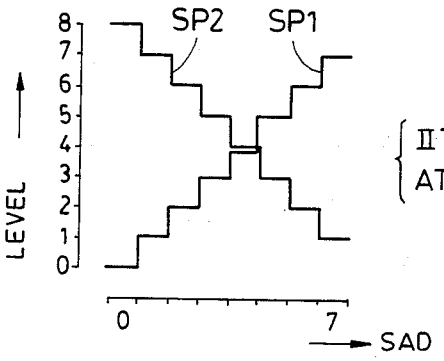

The scaling parameter generator 20 shown in FIG. 1 stores the scaling characteristics functions for one stroke of slope for the respective systems and reads out the scaling parameters SP1, SP2 by making distinction between the case in which the slope of the first system I is negative and the slope of the second system II is positive and the opposite case. For such distinction, the scaling parameter generator 20 is provided with the IITOI signal. When the IITOI signal is "0", the generator 20 reads out the scaling parameters SP1, SP2 of the respective systems according to the scaling characteristics functions in which said slope is negative in the first system I and positive in the second system II as shown in FIG. 4*a* whereas, when the IITOI signal is "1", the generator 20 reads out the scaling parameters SP1, SP2 of the respective systems according to the scaling characteristics functions in which the slope of the first system I is positive and the slope of the second system II is negative as shown in FIG. 4*b*. The scaling parameters SP1, SP2 divided into nine steps 0 to 8 are read out according to the scaling address data SAD divided into eight steps 0 to 7, as shown. When the scaling address data SAD is "0", one of the parameters SP1 or SP2 is at level 0 and the other at level 8, the respective one of the levels of SP1 and SP2 increasing and the other decreasing each by one step as the address advances stepwise. Accordingly, the levels of both parameters SP1 and SP2 when added are always equivalent to 8 so that the key scaling may not vary the overall volume level.

For example, in the first half of the second octave of the scaling pattern shown in the upper row of FIG. 2(*a*), the scaling parameters SP1, SP2 are generated in the manner as shown in FIG. 4*a* whereas in the second half of the second octave, the scaling parameters SP1, SP2 are generated in the manner as shown in FIG. 4*b*. In the first half of the second octave of the pattern shown in the lower row of FIG. 2(*a*), the scaling parameters SP1, SP2 are generated in the manner as shown in FIG. 4*b* whereas in the second half of the second octave, the parameters SP1, SP2 are generated in the manner as shown in FIG. 4*a*. Thus the signs of the slopes of the scaling characteristics in a certain compass having one of the waveshapes I and II in the start address are quite opposite to those of the scaling characteristics in the same compass having the other waveshape in the start address.

In FIG. 2(*a*) one scaling characteristics slope has a horizontal distance or a run equivalent to a semioctave so that the least significant three bits N3, N2, N1 of the note code can be used as the 3-bit scaling address data SAD. Therefore, the relative pitches (i.e., corresponding to SAD) for reading out the scaling parameters SP1, SP2 correspond to the individual scale notes in the semioctave.

In FIG. 2(*b*), one scaling characteristics slope has a run equivalent to one octave so that the most significant three bits N4, N3, N2 of the note code are used as the 3-bit scaling address data SAD. In this case, the relative tone pitches for reading out the scaling parameters SP1, SP2 correspond to one-eighth of the scale notes in one octave. Similarly, in FIGS. 2(*c*) and (*d*), three bits of the key code KC obtained by shifting according to the compass covered by one scaling characteristics slope are used as the scaling address data SAD and the relative tone pitches for one address correspond to several scale note groups.

The interval data INT, start address data STA, start address distinction data STAII/I, and start octave data STO are all included in the tone parameter produced by the tone parameter generator 23.

Reverting to FIG. 1, the waveshape designation means 14 will be described below in detail.

The keyboard circuit 10 produces the key code KC of which the octave code B3 to B1 is added to the A input of a subtractor 24 and the note code N4 to N1 is added to the gate 25. The B input of the subtractor 24 is supplied with the start octave data STO corresponding to the designated tone color to perform the "A–B" subtraction. The subtractor 24 is provided to convert the octave code B3 to B1 of the depressed key into an octave code B3' to B1' which is based on the start octave. The octave code B3' to B1' which is the subtraction result by the subtractor 24 is applied to the gate 25. The subtractor 24 produces "1" as the sign signal So when the subtraction result is 0 or positive and produces "0" when the subtraction result is negative. The sign signal So is supplied through an AND gate 26 to the control input of the gate 25, enabling the gate 25 when it is "1". The other input of the AND gate 26 is supplied with a signal obtained by inverting the attack signal ATCK by an inverter 27. The attack signal ATCK is turned to "1" when a tone color not to be subjected to the key scaling is designated. When a tone color to be subjected to the key scaling is designated, the signal ATCK is turned to "0" so the AND gate is enabled and the gate 25 is controlled in response to the sign signal So.

The output of the gate 25 is applied to a bit shift circuit 28. The bit shift circuit 28 controls the bit shift amount according to the interval data INT. More specifically, the circuit 28 shifts the supplied 7-bit key code B3'–B1' and N4–N1 downwards according to the value of the interval data INT, as shown in the table below. The characters A7 to A1 designate the output bits of the bit shift circuit 28.

TABLE 1

| INT | (MSB) A7 | A6 | A5 | A4 | A3 | A2 | (LSB) A1 |
|---|---|---|---|---|---|---|---|
| ½ | B3' | B2' | B1' | N4 | N3 | N2 | N1 |
| 1 | | B3' | B2' | B1' | N4 | N3 | N2 |
| 2 | | | B3' | B2' | B1' | N4 | N3 |
| 4 | | | | B3' | B2' | B1' | N4 |

As will be described, the bit shift circuit 28 functions to set a compass corresponding to one waveshape according to the designated tone color and set the number of scales for one step of the scaling address data SAD according to the designated tone color.

An adder 29 consists of 6-bit full-address of which one input composed of the least significant three bits is given with the output of the most significant three bits A7 to A5 of the bit shift circuit 28, the other input is given with said 6-bit start address STA, and the carry input Ci which is the least significant bit receives the carry output Co of an adder 30. The 6-bit output of the adder 29 is applied to an adder 31 on one hand and to the waveshape selection address of the waveshape memory 13 as the second-system waveshape designating code WD2 on the other.

The fourth-bit output A4 of the bit shift circuit 28 is applied to the adder 30 and added with the start address distinction signal STAII/I. The output of the adder 30 is applied to the least significant bit of the adder 31 as well as to the scaling parameter generator 20 as the IITOI signal. The 6-bit output of the adder 31 is applied to the waveshape selection address input of the waveshape memory 12 as the first-channel waveshape designating code WD1. The output A3 to A1 of the least significant three bits of the bit shift circuit 28 is supplied to the scaling parameter generator 20 as the scaling address data SAD.

The operation of the circuit shown in FIG. 1 will be described below referring to the pattern shown in the upper row of FIG. 2(*a*) by way of example.

Where the depressed key belongs to the first octave, the octave code B3 to B1 is "001" (1 in decimal) while the start octave data STO is "2" indicating the second octave, so the subtraction result by the subtractor 24 is negative and the sign signal So is "0". Therefore, the gate 25 is closed so that the input data to the bit shift circuit 28 is all "0" and its output bits A7 to A1 are all "0" irrespective of the value of the interval data INT. Because one input A7 to A5 to the adder 29 is all "0", the start address data STA applied to the other input is produced intact from the adder 29. Because the start address distinction signal STAII/I is always "0" in the pattern shown in the upper row of FIG. 2(*a*), the output of the adder 30 is also "0" so that the adder 31 produces the output of the adder 29 as it is. Therefore, the first- and second- system waveshape designating codes WD1, WD2 both designate the start address (e.g., the waveshape address 7 in FIG. 3) to select waveshapes I-1, II-1. Further, because the output of the adder 30 is "0", the IITOI signal is also "0" so that the scaling pattern shown in FIG. 4*a* is selected. However, because the output bits A3 to A1 of the bit shift circuit 28 are always "0" in the first octave, so is the scaling address data and, therefore, the first-system scaling parameter SP1 is read out at the maximum level while the second-system scaling parameter SP2 is read out at level 0. As a result, only the tone signal corresponding to the first-system waveshape I-1 is allowed to reach the sound system 21 through the adder 19 whereas the tone signal corresponding to the second-system waveshape II-I is stopped by the multiplier 16. In this way, the key scaling is not effected in the compass lower than the given start octave (the second octave in the above case) which is determined in accordance with the designated tone color so that the tone signal produced has the same waveshape I-1 at any pitch in such lower compass.

Where the depressed key belongs to the start octave (the second octave in the above example), the subtraction result of the subtractor 24 is "0" so that the sign signal So is "1". Accordingly, the gate 25 is opened and the bit shift circuit 28 is supplied with the note code N4 to N1 indicating the note of the depressed key and the relative octave code B3′–B1′ ("000" in this example) of the depressed key corresponding to the start octave. In the example shown in FIG. 2(*a*) the interval data INT is "½" so that, as is clear from said Table 1, the input bits B3′ to N1 are produced from the bit shift circuit 28 as the output bits A7 to A1 without bit shifting. Therefore, the bits A7 to A5 are all "0" as are B3′ to B1′ and the adder 29 produces the start address data STA (e.g., the waveshape address 7 shown in FIG. 3).

Where the depressed key belongs to the first half of the second octave, the most significant bit N4 is "0" and the output of the adder 30 is "0". Therefore the first- and second-system waveshape designating codes WD1, WD2 both designate the start address and select the waveshapes I-1, II-1. Meanwhile the IITOI signal is "0" and designates the scaling parameter shown in FIG. 4*a*. The least significant three bits N3 to N1 of the note code serve as the scaling address data SAD and a scaling address peculiar to each of six scale notes in the first half of the octave is designated so that the scaling parameters SP1, SP2 of different levels are read out for the respective scale notes according to the characteristics shown in FIG. 4*a*. The tone signals corresponding to the waveshapes I-1, II-1 which are read out from the waveshape memories 12, 13 are weighted respectively by the multipliers 15, 16 and added by the adder 19. Thus, the key scaling of the pattern shown in the upper row of FIG. 2(*a*) is executed in the first half of the second octave.

Where the depressed key belongs to the second half of the second octave, the most significant bit N4 of the note code is "1" and the output of the adder 30 is "1". Therefore, the output of the adder 30 is added with a 1 by the adder 31 so that the first waveshape designating code WD1 designates the address 8 following the address 7 while the second waveshape designating code WD2 designates the start address 7 so that the waveshapes I-2, II-1 are selected respectively in the waveshape memories 12, 13. Meantime the IITOI signal is "1" so the pattern shown in FIG. 4*b* is selected and parameters SP1, SP2 peculiar to each of the six scale notes in the second half of the octave are read out according to the characteristics shown in FIG. 4*b*. Thus the key scaling of the pattern shown in the upper row of FIG. 2(*a*) is executed in the second half of the second octave.

Where the depressed key belongs to the third octave or higher, the output B3′ to B1′ of the subtractor 24 has an according value, to which the bits A7 to A5 correspond. The adder 29 produces address data which is some addresses ahead of the start address STA, whereby the waveshapes used for the key scaling vary such as, I-2 and II-2, II-2 and I-3, and the like. Except these, the same operation is performed to execute the key scaling according to the pattern shown in the upper row of FIG. 2(*a*).

Where the tone color corrsponding to the pattern shown in the lower row of FIG. 2(*a*) is designated, the circuit operates as follows.

In this case, the start address distinction signal STAII/I is always "1" so that the adder 30 produces "1" from the S output when the output bit A4 of the bit shift circuit 28 is "0" and produces "1" from the carry output Co when the bit A4 is "1" (at this time, the S output is "0"). Except for these, a like operation as in the previous case is performed.

More specifically, where the depressed key belongs to the first octave (the compass lower than the start octave), the adder 29 produces the start address data STA (e.g., the waveshape address 11 given in FIG. 3) which serves as the second-system waveshape designating code WD2. Meantime, since the bit A4 is "0", the output "1" of the adder 30 is added to the adder 31 so that the start address data STA added with 1 (e.g., the waveshape address 12 given in FIG. 3) makes the first-system waveshape designating code WD1. Thus the first waveshapes I-1, II-1 (corresponding to the lowermost compass), though in different waveshape addresses from each other by one, of the designated tone color are selected in the respective waveshape memories 12, 13. Meantime, since the output of the adder 30 is "1", the IITOI signal is "1", thus designating the scaling pattern shown in FIG. 4*b*. Where the depressed key belongs to the compass lower than the start octave, the scaling address data SAD is always "0" as before so that the parameter SP1 shows level 0 while the parameter SP2 shows the maximum level. Thus, the key scaling is not effected and only the tone signal corresponding to the waveshape II-1 reaches the sound system 21.

Where the depressed key belongs to the first half of the start octave (the second octave), the output bits A7 to A5 and A4 of the bit shift circuit 28 are all "0". Accordingly, as before, the waveshapes I-1, II-1 are selected in response to the waveshape designating codes WD1, WD2 so that the scaling pattern as shown in FIG. 4*b* is designated in response to "1" of the IITOI signal. The least significant three bits N3 to N1 of the note code serve as the scaling address data SAD and scaling addresses peculiar to the respective six scale notes in the first half of the octave are designated so that the scaling parameters SP1, SP2 of different levels corresponding to the respective scale notes are read out according to the characteristics shown in FIG. 4*b*. In this way, the key scaling is effected which shifts from the waveshape II-1 to I-1 as shown in the first half of the second octave in the lower row of FIG. 2(*a*).

Where the depressed key belongs to the second half of the start octave (the second octave), the output bits A7 to A5 are all "0" but the bit A4 is "1". Therefore, the carry output Co of the adder 30 is "1" and the S output is "0" so that "1" is added to the carry input Ci of the adder 29 and the output of the adder 29 indicates a value (e.g., the waveshape address 12 given in FIG. 3) which is greater by 1 than the start address data STA. The adder 31 does not carry out an addition of 1 so that the waveshape designating codes WD1, WD2 designate the same address 12 to select the wave-shapes I-1, II-2. In response to "0" of the IITOI signal, the scaling pattern shown in FIG. 4*a* is selected to execute the key scaling which shifts from the waveshape I-1 to II-2.

Where the depressed key belongs to an octave higher than the start octave, the output bits B3′ to B1′ of the subtractor 24 have according values, to which the bits A7 to A5 correspond. The adder 29 produces address data which is some addresses ahead of the start address data STA, whereby the waveshapes used for the key scaling vary such as II-2 and I-2, I-2 and II-3, and the like. Except these, the circuit operates as in the previous case to execute the key scaling shown in the lower row of FIG. 2(*a*).

Where tone colors corresponding to the patterns shown in FIGS. 2(*b*), (*c*) and (*d*) are designated, the circuit operates as below.

In this case, the circuit operates in exactly the same manner as in the previous cases except that the key code B3′ to B1′, N4 to N1 are shifted downwardly in response to the value of the interval data INT, as shown in Table 1. As a result of shifting, the relation between the pitch data A3 to A1 for designating waveshapes and the pitch data for designating the scaling addresses on one hand and the actual pitch data (key code B3 to N1) on the other changes such that the compass corresponding to one waveshape is widened according to the amount of shifting and the compass for one scaling address is widened according to the amount of shifting. More specifically, when the interval data INT is "1", the bits A6, A5, A4 correspond to the octave code B3′, B2′, B1′ so that the slope of the scaling characteristics changes every octave while the bits A3 to A1 correspond to the most significant three bits N4 to N2 of the note code so that the steps of the scaling parameters SP1, SP2 change every one-eighth of the one-octave scale. When the interval data INT is "2", the bits A5, A4 correspond to the most significant two bits B3′, B2′ of the octave code so that the slope of the scaling characteristics changes every other octave while the bits A3 to A1 correspond to the bits B1′, N4, N3 so that the steps of the scaling parameters SP1, SP2 change every one-eighth of the two-octave scale. When the interval data INT is "4", the bits A4 correspond to the bit B3′ so that the slope of the scaling characteristics changes every four octaves and the steps of the parameters SP1, SP2 change every one-eighth of the four-octave scale.

Figure 5:
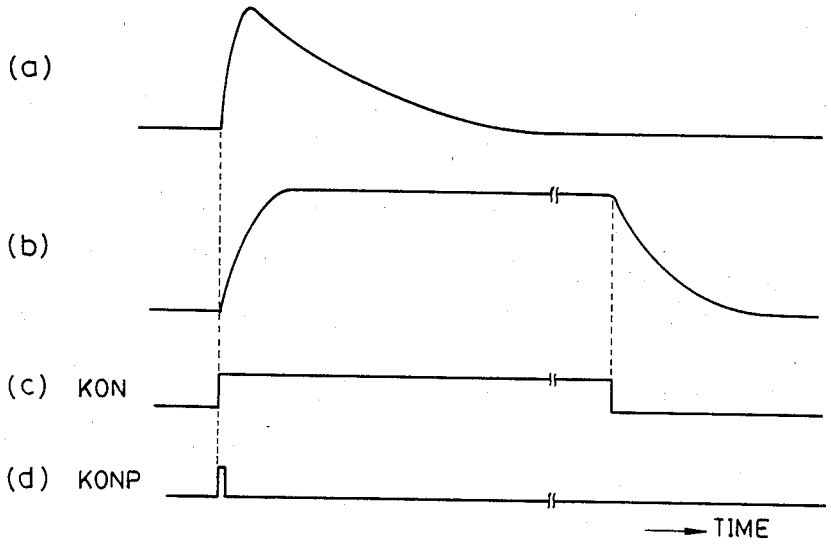
FIG. 5 is a time chart showing an example of generation of attack and sustain envelope shapes in the above embodiment.

An envelope generator 32 produces an attack or percussive envelope shape as shown in FIG. 5(*a*) in response to the key-on pulse KONP (see FIG. 5(*d*)) supplied from the keyboard 10. Another envelope generator 33 produces a sustaining or lasting envelope waveshape as shown in FIG. 5(*b*) in response to the key-on signal KON (see FIG. 5(*c*).

The tone parameter produced by the tone parameter generator 23 includes the attack signal ATCK which is turned to "1" when a given tone color is designated. The attack signal ATCK is applied to the scaling parameter generator 20 as well as to a selector 34 when the attack signal ATCK is "0". The scaling parameter generator 20 is able to produce the scaling characteristics functions as shown in FIG. 4*a*, 4*b* but when the attack signal ATCK is "1", the generator 20 fixes both the scaling parameters SP1, SP2 at the maximum level 8. When the attack signal ATCK is "0", the selector 34 selects the resonant envelope shape signal from the envelope generator 33 and when the attack signal ATCK is "1", the selector 34 selects and supplies the attack envelope system shape signal from the envelope generator 32 to the first-system multiplier 17.

The second-system multiplier 18 is provided at all times with the sustaining envelope shape signal from the envelope generator 33. When a tone color to be subjected to the key scaling is selected, the attack signal ATCK is "0" and the generator 20 produces the parameters SP1, SP2 in accordance with the scaling characteristics while the multipliers 17, 18 of both systems are supplied with the same sustaining envelope shape signal, thereby providing the key-scaled tone signal with the sustaining envelope.

When a tone color to be provided with the attack effect is selected, the attack signal ATCK is turned to "1" and the attack envelope shape signal of the envelope generator 32 is selected by the selector 34 and applied to the multiplier 17. The signal ATCK in the 1 state is inverted by the inverter 27 whose output signal "0" through the AND gate 26 closes the gate 25 so that the waveshape designating codes WD1, WD2 exclusively correspond to the start address STA. One of the tone signals corresponding to two different waveshapes thus selected is provided with the attack envelope (the first system I) while the other signal is provided with the sustaining envelope (the second system II), and both signals are synthesized by the adder 19 before reaching the sound system 21. To provide such two-system tone signal generating means produces a by-product whereby the attack effect can be afforded to the tone colors which are not subjected to the key scaling. At this time, the waveshapes of the systems I and II are different from each other and the tone color (waveshape I) different from the normal tone color (waveshape II) is emphasized at the rise of the tone.

Figure 6:
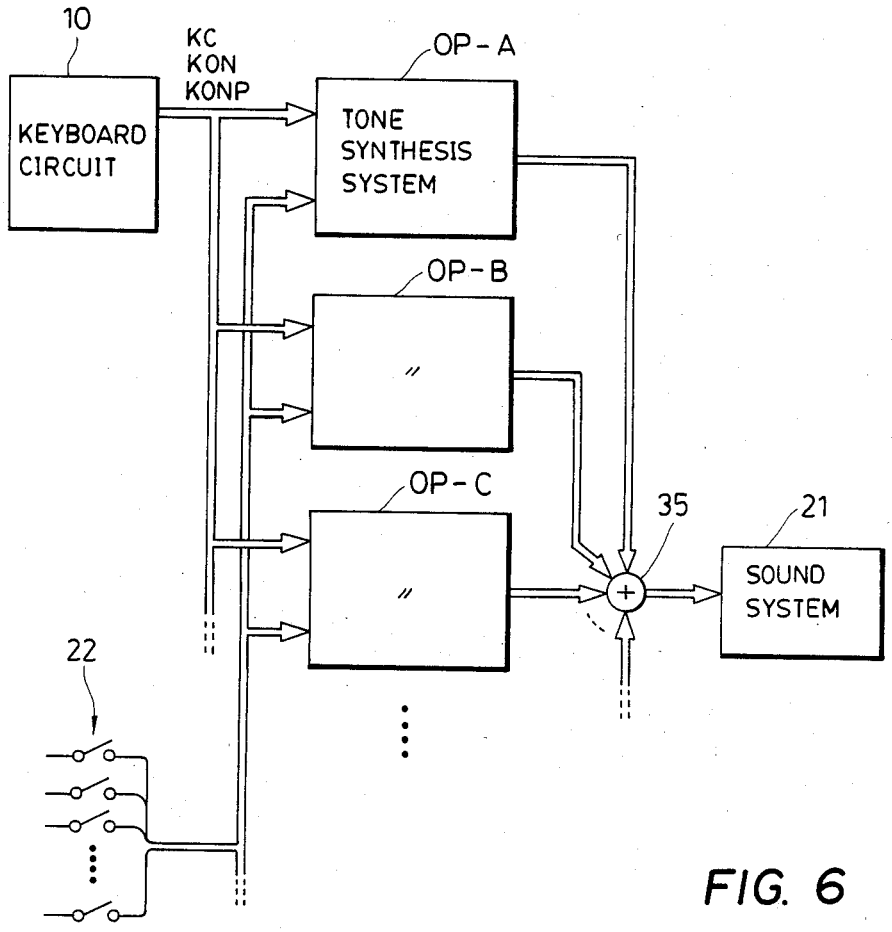
FIG. 6 is an electrical block diagram showing another embodiment of the electronic musical instrument according to the invention.

FIG. 6 shows an example of an electronic musical instrument comprising a plurality of tone synthesis operators (tone synthesis systems) OP-A, OP-B, OP-C, . . . arranged in parallel each of which is identical in structure to the circuit portion OP enclosed in a chain-dot line in FIG. 1. The output tone signals from the respective systems OP-A to OP-C are added together by the adder 35 before reaching the sound system 21. While the system OP-A to OP-C are each provided with the common pitch designating data and tone selection data from the keyboard 10 and the tone color selection switch 22, the pitches or the key scaling characteristics of the tones generated are made different from one another among the systems. This is made possible, for example, by varying the phase change rate of the phase address generator 11, the contents of the tone parameter produced by the tone parameter generator 23, the contents of the scaling parameter generator 20, the contents of the envelope generator 32, 33, the memory contents of the waveshape memories 12, 13 or the like among the systems OP-A to OP-C. Alternatively, tone signals of a certain tone color may be made to undergo the key scaling in one system, e.g., the system OP-A whereas the tone signals of that same tone color are not subjected to the key scaling but provided with the attack effect in another system, e.g., the system OP-B.

While in the above embodiment, the waveshapes selected according to the designation by the waveshape designating codes WD1, WD2 consist of one-period waveshapes, those selected waveshapes may consist of plural-period waveshapes. The tone generation means may be formed by not only the waveshape memories 12, 13 but also any other alternatives which can selectively produce more than one kind of different waveshape signals. Here, one kind of waveshape signal is not limited to waveshape signals which repeat the same waveshape but may be those whose waveshape changes with time. Also, the waveshape signals and scaling parameters may be produced in time division in the first and the second systems to perform the scaling operation in time division.

Further the scaling characteristics function is not limited to a linear function but may be an exponential function, logarithmic function, or any other type of function.

What is claimed is:

1. An electronic musical instrument comprising:

tone pitch designation means for designating the tone pitch of a tone to be generated;

plural tone generation channels associated with a single generated tone, each of the channels including a respective means for generating a waveshape signal selectable from among waveshape signals of plural kinds;

waveshape designation means for designating which of said plural selectable waveshape signals is to be selectively generated in each of said respective waveshape generating means associated with the respective tone generation channels in accordance with the tone pitch designated by said tone pitch designation means; and weighting means for weighting the waveshape signals selectively generated by the respective channel associated waveshape generating means in response to said designation, said single tone being generated from said weighted selectively generated waveshape signals.

2. An electronic musical instrument as defined in claim 1 wherein said weighting means weights the tone signals generated by said respective channel tone generating means at a ratio determined according to said tone pitch.

3. An electronic musical instrument as defined in claim 2 wherein said waveshape designation means designates the waveshape signals in accordance with tone color designation information and a tone range to which the designated tone pitch belongs.

4. An electronic musical instrument as defined in claim 2 wherein said weighting means weights the tone signals at a ratio determined by a predetermined scaling characteristic in the form of a function which is defined with the designated tone pitch as variable.

5. An electronic musical instrument as defined in claim 4 wherein said scaling characteristic function is determined according to the tone color designation information.

6. An electronic musical instrument as defined in claim 2 wherein said waveshape designation means designates waveshape signals which differ from each other between the respective channels and the ratio of weighting in said weighting means is determined by a relative position of the designated tone pitch in a tone range having a predetermined width to which the designated tone pitch belongs.

7. An electronic musical instrument as defined in claim 6 wherein the width of said tone range is controlled by the tone color designation information.

8. An electronic musical instrument as defined in claim 1 which further comprises:

envelope imparting means for imparting amplitude envelopes to the tone signals generated by the respective channels tone generation means; and means for selecting, in response to the tone color designated by said tone color designation means, either enabling weighting by said weighting means depending upon the designated tone pitch or enabling imparting by said envelope imparting means of envelopes which differ from each other, to the tone signals of the respective channels.

9. An electronic musical instrument as defined in claim 8 wherein said envelopes which differ from each other are an attack envelope and a sustain envelope.

10. An electronic musical instrument comprising:

tone pitch designation means for designating the tone pitch of a tone to be generated;

a plurality of tone synthesis systems each comprising plural tone generation channels associated with a single generated tone, each of the channels including a respective means for generating a waveshape signal selectable from among waveshape signals of plural kinds, waveshape designation means for designating which of said plural selectable waveshape signals is to be selectively generated in each of said respective waveshape generating means associated with the respective tone generation channels in accordance with the tone pitch designated by said tone pitch designation means, and weighting means for weighting the selectively generated waveshape signals generated by the respective tone generation channels, said single tone being generated from said weighted selectively generated waveshape signals; and means for adding together the tone signals produced by the respective tone synthesis system thereby to synthesize a tone signal.

11. An electronic musical instrument as defined in claim 10 wherein the respective tone synthesis systems further comprise:

envelope imparting means for imparting amplitude envelopes to the tone signals generated by the respective waveshape generating means; and means for selecting, in accordance with the designated tone color, either enabling weighting by said weighting means depending upon the designated tone pitch or enabling imparting by said envelope imparting means of envelopes which differ from each other, to the tone signals of the respective channels.

12. An electronic musical instrument as defined in claim 3 wherein each of said respective waveshape generating means are comprised of waveshape memories each containing a plurality of different waveshapes corresponding to the same tone color designation.

13. An electronic musical instrument as defined in claim 12 wherein said waveshape memories are formatted so that said different waveshapes corresponding to the same tone color designation are stored in continuous waveshape addresses, said different waveshapes corresponding to the same tone color designation being utilized in accordance with said tone range to which the designated tone pitch belongs.

* * * * *